US005653817A

United States Patent [19]

Schünke et al.

[11] Patent Number: 5,653,817

[45] Date of Patent: Aug. 5, 1997

[54] PROCESS FOR REMOVING MELTABLE ORGANIC MATERIAL APPLIED TO THE SURFACE OF A COMPONENT OF A PROPULSION UNIT, SUCH AS A TURBINE

[75] Inventors: Detlev Schünke, München; Monika Manier, Mitterscheyern; Martin Thoma, München, all of Germany

[73] Assignee: MTU Motoren-Und Turbinen-Union München GmbH, München, Germany

[21] Appl. No.: 416,224

[22] Filed: Apr. 4, 1995

[30] Foreign Application Priority Data

Apr. 5, 1994 [DE] Germany ..... 44 11 677.2

[51] Int. Cl.[6] ..... B08B 3/08; B08B 5/04; C23G 1/00; C23G 5/02

[52] U.S. Cl. ..... 134/5; 134/19; 134/26; 134/21; 134/38; 134/40

[58] Field of Search ..... 134/5, 19, 21, 134/38, 40, 26

[56] References Cited

U.S. PATENT DOCUMENTS 5,064,487 11/1991 Fourné ..... 134/5

5,209,785 5/1993 Brewe et al. ..... 134/5

5,484,488 1/1996 Hart et al. ..... 134/40

*Primary Examiner*—Zeinab El-Arini

[57] ABSTRACT

A process for the removal of organic materials from the surfaces of drive components, particularly for the removal of meltable organic coatings, fillings or damping materials. The organic material is first melted in a bath of the same or similar organic material and an adhering residual film is diluted and stripped off from the preheated drive component by applying tempered oil thereto. After this, a diluting and striping off of a material film, which essentially consists of oil molecules still adhering to the surface, is conducted by applying an organic cleaning agent, which is free of fluorochlorohydrocarbons and chlorohydrocarbons. Then a post-treatment of the surfaces of the drive component is effected by one or more steps of applying diluted cleaning solutions with intermediate rinsing and/or drying steps, in which the cleaning solutions are increasingly diluted stepwise.

15 Claims, No Drawings

PROCESS FOR REMOVING MELTABLE ORGANIC MATERIAL APPLIED TO THE SURFACE OF A COMPONENT OF A PROPULSION UNIT, SUCH AS A TURBINE

FIELD OF THE INVENTION

The invention relates to a process for removing meltable organic materials which are applied on components of a propulsion unit, such as a drive turbine, for coating, filling or damping purposes.

BACKGROUND

In the manufacture of new components of propulsion units and in the reconditioning of used components thereof, wax or wax mixtures are applied to the components for various purposes, such as for coating, for laser drilling, for etching of surface layers, and in machining operations. Additionally, when the surfaces of components are not corrosion resistant, they are provided with protective coatings for storage which contain oil or wax. It is known to remove such organic materials in a facility that operates with chlorohydrocarbons (for example, trichloroethylene or tetrachloroethylene) or fluorochlorohydrocarbons (for example, trichlorotrifluoroethane or dichlorotetrafluoroethane) to dissolve the wax-type materials.

Plants which operate with chlorohydrocarbons or fluorochlorohydrocarbons are expensive in their care and maintenance. This is based partly on strict requirements with respect to environmental and work protection. Furthermore, relatively high cost expenditure must be made to assure a reliable operation of these facilities. Furthermore, chlorohydrocarbons can be used only to a limited extent for cleaning the surfaces of structural parts made of titanium, which are utilized frequently as drive components, due to the danger of increased stress corrosion cracking of the titanium after contact thereof with chlorohydrocarbons.

SUMMARY OF THE INVENTION

An object of the invention it to provide a process for removing meltable organic materials from the drive components of propulsion units, which avoids the disadvantages of the known systems and in which the surfaces of the drive components are cleaned in a cost-favorable, reproducible, and reliable manner, and without polluting the environment and the workplace.

This object is satisfied by a process comprising:

a) melting the organic material on the surface of the drive component in a bath which is the same or similar in type to the organic material, b) diluting and stripping an adhering residual film of the organic material by a tempered oil applied to the preheated drive component, c) diluting and stripping a material film still adhering to the surfaces by applying an organic cleaning agent, which is free of fluorochlorohydrocarbons and chlorohydrocarbons, and d) effecting one or more post-treatments of the surface of the drive component by applying successive dilute cleaning solutions with intermediate steps of rinsing and/or drying, in which the cleaning solutions are increasingly diluted stepwise.

An advantage of the above process is that the meltable Organic material is recovered completely in process step a) except for the residual film adhering to the drive component and without great technical expenditure. The thickness of the residual film can be minimized by increasing the temperature of the bath and the temperature of the drive component immersed in the bath.

In addition, the tempered oil used in process step b) may be used several times before it is separated by distillation or other separating processes from the organic material absorbed in process step b), and then regenerated.

Finally, all of the cleaning and rinsing steps of this process may advantageously be conducted in cyclic processes, whereby the cleaning agents and cleaning solutions can be recovered by reverse osmosis, ultrafiltration, and/or distillation without polluting the environment.

In a preferred embodiment of conducting the process, the adhering residual film is dissolved in a mineral oil or fully synthetic oil having a density of 0.6–0.8 g/cm$^3$. Such specific light oil has the advantage that the heavier organic material settles to the bottom of the oil bath and the upper region of the oil bath remains ready for use.

In another preferred embodiment of conducting the process, the adhering residual film is dissolved in an oil bath at a bath temperature of 80° C. to 150° C. Such a relatively high bath temperature contributes to the effect that on the one hand, there is a rapid stripping and diluting of the residual film, and on the other hand, the material adhering to the surface of the drive component and essentially consisting of oil molecules is minimized with respect to its thickness.

The post-treatment of the material film may be conducted by cleaning agents based on alcohol. Preferably, the post-treatment of the material film can be conducted by means of a cleaning agent comprising 0.1 vol. % to 1 vol. % surfactant and 99 vol. % to 99.9 vol. % glycol derivative or mixtures of glycol derivatives. This cleaning agent can completely dissolve the material film remaining on the surface of the component, which essentially consists of oil molecules, without the necessity of application of chlorohydrocarbons or fluorochlorohydrocarbons. The glycol derivatives, in turn, are water-soluble and may be removed by simple rinsing steps with water from the surface of the drive component. Preferably, distilled and/or demineralized water is used for this purpose.

Cleaning agents based on glycol preferably contain at least one of the following glycol derivatives:

a) $R_1$—$(OC_2H_4)OH$ wherein $R_1$ is $CH_3$, $C_2H_5$, $C_3H_7$ or $C_4H_9$ b) $R_1$—$(OC_2H_4)_2O_2CCH_3$ wherein $R_1$ is $CH_3$, $C_2H_5$, $C_3H_7$ or $C_4H_9$ c) $R_2$—$(C_2H_4O)_nH$ wherein:

$R_2$ is $CH_3O$, $C_2H_5O$ or $C_3H_7O$, and n=2 to 5

These cleaning agents have the advantage that the glycol derivatives can be recovered by a simple distillation process and thus can be used again, so that a cyclic process is possible.

Preferably, the cleaning agent is applied in degrees of dilution with water in a ratio of 1:1 to 1:10 as a cleaning solution for post-treatment. In this way, the cleaning solutions are increasingly diluted stepwise. Within the preferred limits of dilution, a particularly effective cleaning of the surfaces is obtained, which may be conducted without additional control processes.

In the cleaning operation, the cleaning agents and/or cleaning solutions are preferably heated to 60° C. to 80° C.

This improves the effect of surfactants in the cleaning agent and increases the cleaning effect of the cleaning solutions. The water used for rinsing is preferably heated to 80° C. to 95° C. If rinsing or cleaning is conducted with alcohol, the alcohol can be heated to just under its boiling point in order to assure a cleaning of the adhering residual materials or a rinsing off of remaining residual substances from the surface.

A drying operation, using hot air at a temperature between 100° and 150° C., can be used preferably between the rinsing and cleaning steps. Aqueous liquids are advantageously evaporated in this preferred temperature range. In order to advantageously free the surfaces of any contamination, a vacuum drying step can be conducted, preferably as a last drying step.

DETAILED DESCRIPTION OF THE INVENTION

The process of the invention will be described hereafter in detail with reference to specific examples thereof.

EXAMPLE 1

In the laser drilling of a turbine blade, the cooling channels of the turbine blade are filled with a wax, which softens at 75° C. and has a melt temperature between 80° and 85° C. This wax is preferably a minerally saturated hydrocarbon wax, which is solid between 73° C. and 78° C. After laser drilling, the turbine blade is heated to 80° C. and immersed in a bath of the same or similar type of molten wax, which has been heated to 110° C. When the turbine blade is removed from the bath of molten wax, the wax flows from the cooling channels of the turbine blade. A residual film of wax, which adheres to the inside walls of the cooling channels, is then diluted and stripped in a 120° C. hot oil bath for 15 to 30 minutes. When the turbine blade is removed from the oil bath, a thin material film remains on the surface of the turbine blade, which consists essentially of oil molecules. This material film is diluted and stripped off with a cleaning agent based on dialcohol derivatives having a flashpoint of 80° to 130° C. at a temperature between 60° and 80° C. for 15 to 30 minutes and the turbine blade is then rinsed in demineralized water.

After this, the turbine blade is immersed in a neutral cleaning agent which can be used for all metals at a temperature of 60° to 80° C. for 15 to 30 minutes and finally is rinsed for 5 minutes at a temperature of 95° C. in hot demineralized water.

Subsequently, the turbine blade is dried at 130° C. for a period of time of 15 to 45 minutes.

The length of time for the individual process steps depends on the size of the drive component and on the complexity of its configuration. In addition to the removal of the wax filling described above, protective layers and preservation layers can also be removed in the same way, as long as the latter consist of a meltable, organic material.

EXAMPLE 2

Prior to dressing the blade tips of a BLISK rotor (which comprises a rotor disk and integral rotor blades) to its final altered diameter, the intermediate spaces between the blades of the BLISK rotor are first filled with wax in order to damp the vibrations of the blades during the dressing of the tips.

After achieving the final dimension of the blade tips, the BLISK rotor is heated and is immersed in a molten wax bath, so that after melting the primary fraction of the wax filling material, only a residual film of organic material adheres to the rotor surface.

This residual film is stripped off in a tempered oil bath at 130° C. and further diluted, so that only a thin material film remains, which essentially consists of oil molecules. This material film is then stripped off by a cleaning agent, which consists of up to 0.1 vol. % surfactant and up to 99.9 vol. % of a mixture of glycol derivatives, and again diluted, so that it completely disappears from the surface after several sequential rinsing and cleaning steps, in which the dilution of the cleaning solution is increased stepwise.

Finally, the BLISK rotor is subjected to a vacuum drying, so that it is completely freed of contaminations.

EXAMPLE 3

For protection prior to coating, in the case of electrolytic deposition of platinum layers onto a turbine drive component, the regions which are not to be coated with platinum are first protected with a protective layer of a meltable organic material. After the deposition of platinum, the meltable organic material is removed. For this purpose, the drive component is immersed in a bath of the same or similar type of organic material in a basic rinsing and drying step, until only a residual film of minimal thickness of the organic material remains adhered to the turbine component. This residual film is treated in a tempered oil bath, as in example 2, so that only a material film consisting essentially of oil molecules remains on the surface of the component. By means of a cleaning bath, comprised of 0.8 vol. % surfactant and 99.2 vol. % glycol derivatives, this material film is stripped off and further diluted, so that a flushing operation with a cleaning solution and a rinsing operation with distilled and demineralized water completely frees the surface of the component which is not coated with platinum.

EXAMPLE 4

A metal vapor-deposited layer of Ni/Al is to be selectively etched from a turbine structural part in preparation for a repair. During the etching operation, an intermediate nickel layer, which is found in places on the structural part, is to be protected. The structural part itself consists of a nickel-base material. A primary component of the etching solution is a nitroaromatic compound. The base material, the metal vapor-deposited layer, and the nickel layer are not chemically stable in this solution.

For preparation for selective etching, the structural part is cleaned in a neutral cleaning agent and coated with the wax of example 1. The places at which the metal deposition layer of Ni/Al is to be etched are mechanically laid bare.

After the selective etching of the metal layer of Ni/Al, the structural part is then sprayed with cold water and subsequently blow dried.

In order to remove the wax coating on the nickel layer and the nickel-base material of the structural part after the etching has been terminated, the wax coating is melted in a bath of the molten wax, then treated in an oil bath, and finally immersed in a cleaning agent corresponding to example 2 for 15 to 30 minutes at 78° C. After an intermediate rinsing in demineralized water, the structural part is immersed in a cleaning solution in a first dilution stage and rinsed again with hot water. Then the structural part is immersed in a cleaning solution of higher dilution and repeatedly rinsed with hot water. The dilution of the cleaning solution is increased stepwise until only water adheres to the surface of the structural part, and the structural part is completely freed of contamination in a final vacuum drying operation.

Although the invention has been described in connection with specific examples thereof, it will become apparent to those skilled in the art that numerous modifications and variations can be made within the scope and spirit of the invention as defined in the attached claims.

What is claimed is:

1. A process for removal of a meltable organic material from a surface of a component of a propulsion unit made of a material subject to increased stress corrosion cracking when contacted with fluorochlorohydrocarbons and chlorohydrocarbons, said process comprising the following steps:

a) melting the organic material in a molten bath of substantially the same organic material;

b) diluting and stripping off an adhering residual film in a tempered oil applied on the component;

c) diluting and stripping off a material film still adhering to the surface of the component by a cleaning process which consists of applying to said surface of the component an organic cleaning agent, which is free of fluorochlorohydrocarbons and chlorohydrocarbons; and effecting a post-treatment of the surface of the component by applying, to the surface of said component treated by said organic cleaning agent, successive dilute cleaning solutions of said organic cleaning agent with intermediate steps of rinsing with water or drying or both, the cleaning solutions being increasingly diluted stepwise with water in a ratio of 1:2 to 1:10; and d) recovering said organic cleaning agent and re-using said organic cleaning agent in said process.

2. A process according to claim 1, wherein the tempered oil in which the adhering residual film is dissolved is mineral oil or synthetic oil having a density of 0.6–0.8 g/cm$^3$.

3. A process according to claim 1, wherein the adhering residual film is dissolved in an oil bath at a bath temperature of 80° C. to 150° C.

4. A process according to claim 1, wherein said organic cleaning agent comprises 0.1 to 1 vol. % surfactant and 99 to 99.9 vol. % of a glycol derivative or mixtures of glycol derivatives.

5. A process according to claim 4, comprising heating the organic cleaning agent or the cleaning solution or both to 60° to 80° C.

6. A process according to claim 4, wherein the cleaning agent contains at least one of the following glycol derivatives:

a) $R_1$—$(OC_2H_4)OH$
wherein $R_1$ is $CH_3$, $C_2H_5$, $C_3H_7$ or $C_4H_9$ b) $R_1$—$(OC_2H_4)_2O_2CCH_3$
wherein $R_1$ is $CH_3$, $C_2H_5$, $C_3H_7$ or $C_4H_9$.

7. A process according to claim 4, wherein the cleaning agent contains at least one of the following glycol derivatives:

c) $R_2$—$(C_2H_4O)_nH$
wherein:
$R_2$ is $CH_3O$, $C_2H_5O$ or $C_3H_7O$, and
n=2 to 5.

8. A process according to claim 1, wherein said cleaning solutions are diluted with demineralized water.

9. A process according to claim 1, in which the post-treatment comprises successive steps of applying said dilute cleaning solutions and intermediate rinsing solutions.

10. A process according to claim 9, wherein the cleaning and rinsing solutions contain demineralized water.

11. A process according to claim 10, comprising heating the demineralized water to 80° to 95° C. for said intermediate steps of rinsing.

12. A process according to claim 1, comprising effecting a drying step with hot air heated to a temperature between 110° and 150° C.

13. A process according to claim 1, comprising a final drying step comprising vacuum drying.

14. A process according to claim 1, wherein said propulsion unit comprises titanium.

15. A process according to claim 1, wherein said intermediate steps of rinsing are effected with water.

* * * * *